US007699282B2

(12) United States Patent
Bushey et al.

(10) Patent No.: US 7,699,282 B2
(45) Date of Patent: Apr. 20, 2010

(54) CLIP STYLE ARTICLE HOLDER

(76) Inventors: Richard D. Bushey, 1596 38$^{th}$ Ave., Kenosha, WI (US) 53144; Bret L. Bushey, 5535 Sandhill Rd., Caledonia, WI (US) 53402

( * ) Notice: Subject to any disclaimer, the term of this patent is extended or adjusted under 35 U.S.C. 154(b) by 0 days.

(21) Appl. No.: 12/243,362

(22) Filed: Oct. 1, 2008

(65) Prior Publication Data

US 2009/0090682 A1 Apr. 9, 2009

Related U.S. Application Data

(60) Provisional application No. 60/976,618, filed on Oct. 1, 2007.

(51) Int. Cl.
*A47G 1/10* (2006.01)

(52) U.S. Cl. ..... 248/316.7; 40/658

(58) Field of Classification Search ..... 248/316.7, 248/309.1, 313, 339; 24/563, 67.9; 211/45, 211/89.01; 40/658, 649
See application file for complete search history.

(56) References Cited

U.S. PATENT DOCUMENTS

| | | | | |
|---|---|---|---|---|
| 3,350,045 | A | 10/1967 | Mayers | |
| 3,796,405 | A | 3/1974 | Rystad | |
| 3,958,696 | A * | 5/1976 | Leonas | 211/45 |
| 4,767,093 | A | 8/1988 | Jones | |
| 4,899,974 | A * | 2/1990 | Wear et al. | 248/467 |
| D308,547 | S | 6/1990 | Kendes | |
| 5,295,342 | A | 3/1994 | Roche | |
| D355,788 | S | 2/1995 | Irvin | |
| 5,658,014 | A | 8/1997 | Barker | |
| 5,678,792 | A | 10/1997 | Arguin | |
| 5,890,603 | A | 4/1999 | Arguin | |
| D424,120 | S | 5/2000 | Wear | |
| 6,126,126 | A | 10/2000 | McKiernan, Jr. | |
| 6,170,791 | B1 | 1/2001 | Pitcher | |
| 6,257,422 | B1 | 7/2001 | Rios | |
| 6,315,254 | B1 | 11/2001 | Maloney | |
| 6,364,126 | B1 | 4/2002 | Enriquez | |
| 6,398,178 | B1 | 6/2002 | Azola | |
| 6,439,520 | B1 | 8/2002 | Johnson | |
| 6,467,742 | B1 | 10/2002 | Pitcher | |
| 6,471,169 | B1 | 10/2002 | Maloney | |
| 6,637,716 | B2 * | 10/2003 | Wear | 248/489 |
| D520,862 | S | 5/2006 | Munson | |
| 7,083,153 | B1 | 8/2006 | Delatorre | |
| 2007/0113452 | A1 * | 5/2007 | Pollack | 40/658 |
| 2007/0209265 | A1 * | 9/2007 | Robb | 40/658 |

* cited by examiner

*Primary Examiner*—Ramon O Ramirez
(74) *Attorney, Agent, or Firm*—Boyle Fredrickson, S.C.

(57) ABSTRACT

An article holder is provided for supporting a sheet of material on a vertical surface. The article holder includes a backing plate connectable to the vertical surface and a clip operatively connected to the backing plate. The clip includes a face plate and an upper wall interconnecting the upper edge of the face plate and the upper edge of the backing plate. A retaining leg extends from the lower edge of the face plate. The retaining leg moveable between a closed position wherein the terminal end of the retaining leg engages the inner surface of the backing plate and an open position wherein the retaining leg is spaced from the inner surface of the backing plate. The inner surface of the backing plate, the inner surface of the face plate and the inner surface of the upper wall define a cavity for receiving a portion of the sheet.

16 Claims, 2 Drawing Sheets

CLIP STYLE ARTICLE HOLDER

CROSS-REFERENCE TO RELATED APPLICATIONS

This application claims the benefit of U.S. Provisional Application Ser. No. 60/976,618 filed Oct. 1, 2007.

FIELD OF THE INVENTION

This invention relates generally to article holders, and in particular, to a device for releasably holding a sheet of material on a vertical surface such as a cubicle wall, computer monitor or the like.

BACKGROUND OF THE INVENTION

As is known, individuals often refer to sheet or page of material when working on a computer. Alternatively, individuals often like to display various sheets of material such as pictures, calendar pages, notes or the like in their office space. Typically, an individual can insert a thumb tack or pin through the sheet of material to be displayed and into the vertical surface. It can be appreciated that the thumb tack may damage the sheet of material and/or the vertical surface in which the thumb tack is inserted. Alternatively, a user may use tape to affix the sheet of material to the vertical surface. Once again, it can be appreciated that the tape may damage the sheet of material. Further, tape often has insufficient adhesive force to support a sheet of material on the vertical surface for a prolonged period of time. As a result, the sheet of material may fall from the vertical surface.

Various attempts have been made to develop an article holder for supporting sheets of material and loose papers for display on a vertical surface. By way of example, the Rios, U.S. Pat. No. 6,257,422 discloses an article holder utilizing a backing member and a first portion movable relative to the backing member. A hinge interconnects the first portion and the backing member and biases the first portion towards the backing member in a spring-like fashion. A second hinge interconnects the first portion to a second portion that is movable relative to the first portion and extends into a cavity between the first portion and the backing member. The second hinge also biases the second portion towards the backing member. As a result, the article member maybe held between the second portion and the backing member.

Although functional for its intended purpose, the article holder disclosed in the '422 patent is somewhat cumbersome to manufacture. In the first embodiment, the article holder in the '422 patent includes a backing member formed from first and second layers. Alternatively, in the second embodiment wherein the backing member, first portion and second portion are formed from a single layer, a reinforcing means is required to add sufficient strength to the article holder. As a result, it is highly desirable to provide an article holder that is simpler and less expensive to manufacturer than the article holders in the prior art.

Therefore, it is a primary object and feature of the present invention to provide an article holder for supporting a sheet of material on a vertical surface.

It is a further object and feature of the present invention to provide an article holder for supporting a sheet of material on a vertical surface that is simple to utilize and inexpensive to manufacture.

It is a still further object and feature of the present invention to provide an article holder for supporting a sheet of material on a vertical surface that is more durable than prior article holders.

In accordance with the present invention, an article holder is provided for supporting a sheet of material on a vertical surface. The article holder includes a backing plate connectable to the vertical surface. The backing plate has an inner surface and upper edge. A clip operatively connected to the backing plate. The clip includes a face plate and an upper wall. The face plate has an inner surface, an upper edge and a lower edge. The upper wall interconnects the upper edge of the face plate and the upper edge of the backing plate. The upper wall has an inner surface. A retaining leg extends from the lower edge of the face plate and has a terminal end. The retaining leg is moveable between a closed position wherein the terminal end of the retaining leg engages the inner surface of the backing plate and an open position wherein the retaining leg is spaced from the inner surface of the backing plate. The inner surface of the backing plate, the inner surface of the face plate and the inner surface of the upper wall define a cavity for receiving a portion of the sheet.

The upper wall of the clip is generally perpendicular to the backing plate. The face plate of the clip is movable between a first, generally flat configuration with the retaining leg in the closed position and a second, generally arcuate configuration with the retaining leg in the open position. The upper wall of the clip is movable between a first, generally flat configuration with the retaining leg in the closed position and a second, generally arcuate configuration with the retaining leg in the open position.

The backing plate has a width and the face plate of the clip has a width. The width of the backing plate is greater than the width of the face plate of the clip. The backing plate includes an outer surface and the article holder may include an adhesive provided on the outer surface of the backing plate for affixing the backing plate to the vertical surface. Alternatively, the article holder may include a hook extendable through the backing plate and into the vertical surface for retaining the backing plate on the vertical surface. The hook includes first and second legs interconnected by a crossbar. The legs have first and second opposite ends and are generally parallel. The first ends of the first and second legs include hooked elements formed therein.

In accordance with a further aspect of the present invention, an article holder is provided for supporting a sheet of material on a vertical surface. The article holder includes a backing plate connectable to the vertical surface. The backing plate has inner and outer surfaces and an upper edge. A flexible face plate has an inner surface, an upper edge and a lower edge. A flexible upper wall interconnects the upper edge of the face plate and the upper edge of the backing plate. The upper wall has an inner surface. A retaining leg extends from the lower edge of the face plate and has a terminal end. The retaining leg is moveable between a closed position and an open position. In the closed position, the terminal end of the retaining leg engages the inner surface of the backing plate; the face plate is generally parallel to the backing plate; and the upper wall is generally perpendicular to the face plate and the backing plate. In the open position, the retaining leg is spaced from the inner surface of the backing plate; the face plate has a generally arcuate cross-section; and the upper wall has a generally arcuate cross-section.

The inner surface of the backing plate, the inner surface of the face plate and the inner surface of the upper wall define a cavity for receiving a portion of the sheet. The backing plate has a width and the face plate of the clip has a width. The width of the backing plate is greater than the width of the face plate of the clip. The article holder may include an adhesive provided on the outer surface of the backing plate for affixing the backing plate to the vertical surface. Alternatively, the article holder may include a hook extendable through the backing plate and into the vertical surface for retaining the backing plate on the vertical surface. The hook includes first and second legs interconnected by a crossbar. The legs have first and second opposite ends and are generally parallel. The first ends of the first and second legs include hooked elements formed therein.

In accordance with a still further aspect of the present invention, an article holder is provided for supporting a sheet of material on a vertical surface. The article holder includes a backing plate connectable to the vertical surface. The backing plate has inner and outer surfaces, upper edge and a width. A clip is operatively connected to the backing plate. The clip includes a face plate and an upper wall. The face plate has an inner surface, an upper edge, a lower edge and a width. The upper wall interconnects the upper edge of the face plate and the upper edge of the backing plate. The upper wall has an inner surface. A retaining leg extends from the lower edge of the face plate and has a terminal end. The retaining leg moveable between a closed position wherein the terminal end of the retaining leg engages the inner surface of the backing plate and the face plate is generally parallel to the backing plate, and an open position wherein the retaining leg is spaced from the inner surface of the backing plate and the face plate has a generally arcuate cross-section.

The upper wall is generally perpendicular to the face plate and the backing plate with the retaining leg in the closed position. The upper wall has a generally arcuate cross-section with the retaining leg in the open position. The inner surface of the backing plate, the inner surface of the face plate and the inner surface of the upper wall define a cavity for receiving a portion of the sheet. The width of the backing plate is greater than the width of the face plate of the clip.

The article holder may include an adhesive provided on the outer surface of the backing plate for affixing the backing plate to the vertical surface. Alternatively, the article holder may include a hook extendable through the backing plate and into the vertical surface for retaining the backing plate on the vertical surface. The hook includes first and second legs interconnected by a crossbar. The legs have first and second opposite ends and are generally parallel. The first ends of the first and second legs include hooked elements formed therein.

BRIEF DESCRIPTION OF THE DRAWINGS

The drawings furnished herewith illustrate a preferred construction of the present invention in which the above advantages and features are clearly disclosed as well as other which will be readily understood from the following description of the illustrated embodiment.

In the drawings.

DETAILED DESCRIPTION OF THE DRAWINGS

Figure 1:
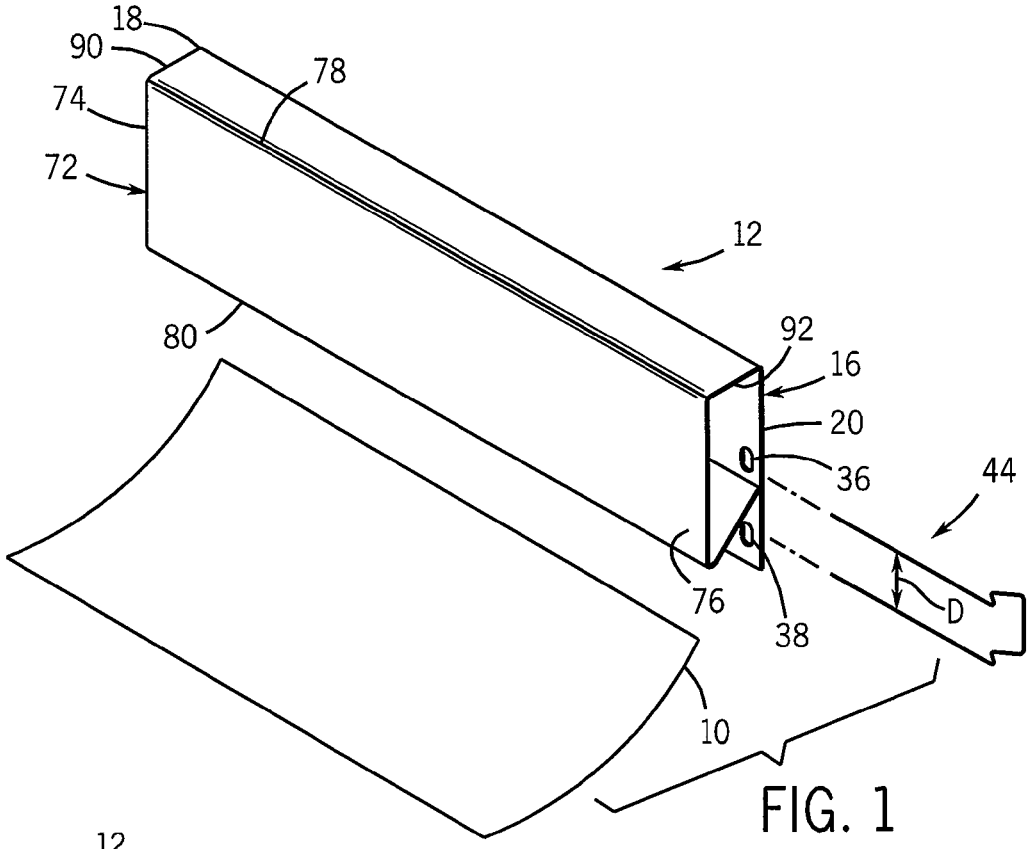
FIG. 1 is an isometric view of an article holder in accordance with the present invention.
Figure 2:
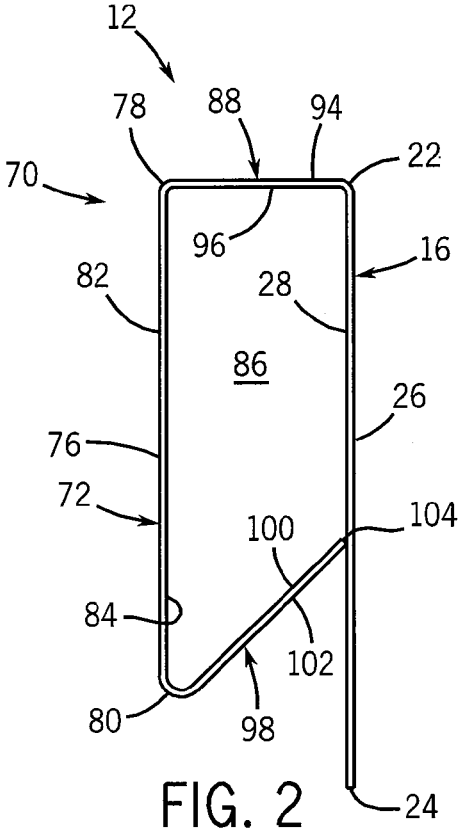
FIG. 2 is a side elevational view of the article holder of FIG. 1 in a closed position.
Figure 3:
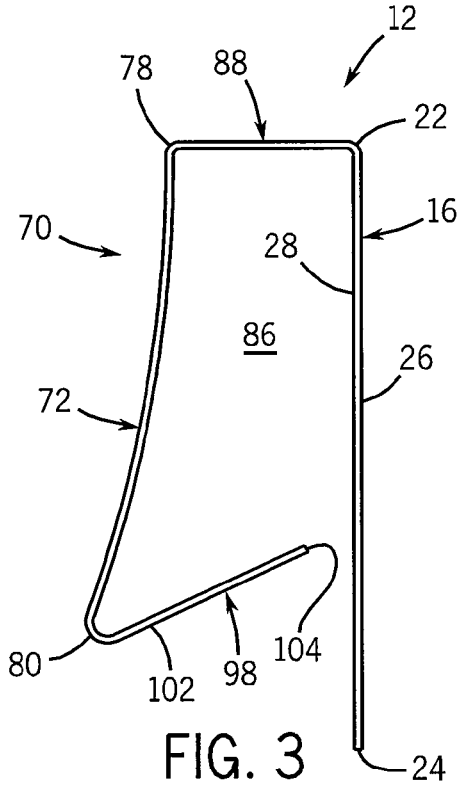
FIG. 3 is a side elevational view, similar to FIG. 2, showing the article holder of the present invention in an opened position.
Figure 4:
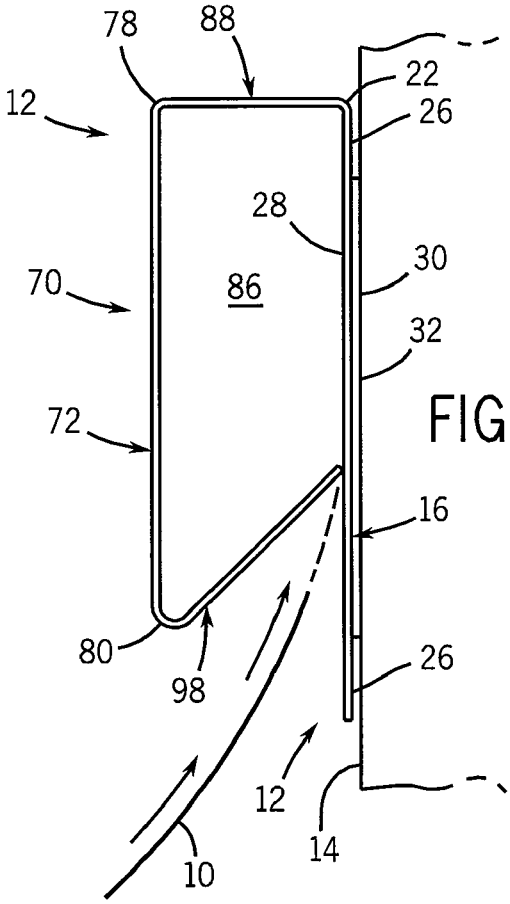
FIG. 4 is a side elevational view, partially in section, showing the article holder of the present invention adapted for receiving a sheet of material therein.

Referring to FIGS. 1-4, an article holder for holding a sheet 10 of material is generally designated by the reference numeral 12. It is intended to mount article holder 12 on a vertical surface 14 such as a cubicle wall, computer monitor or the like, FIG. 4. Article holder 12 includes a generally flat backing plate 16 defined by first and second ends 18 and 20, respectively, and upper and lower edges 22 and 24, respectively. Backing plate 16 further includes rear surface 26 and forward surface 28. Mounting element 30 is affixed to rearward surface 26 of backing plate 16 in any suitable manner such as by adhesive or the like. Mounting element 30 may be fabricated from a pressure sensitive adhesive or a magnet. It is intended for outer surface 32 of mounting element 30 to be positioned against vertical surface 14 so as to retain backing plate 16, and hence article holder 12, on vertical surface 14. Alternatively, article holder 12 may include first and second pin holes 36 and 38, respectively, positioned adjacent both ends 18 and 20 of backing plate 16. First and second pin holes 36 and 38, respectively, adjacent ends 18 and 20 of backing plate 16 are vertically aligned and separated by a predetermined distance D. Pin holes 36 and 38 are adapted to receive corresponding legs 40 and 42 of hook 44.

Figure 5:
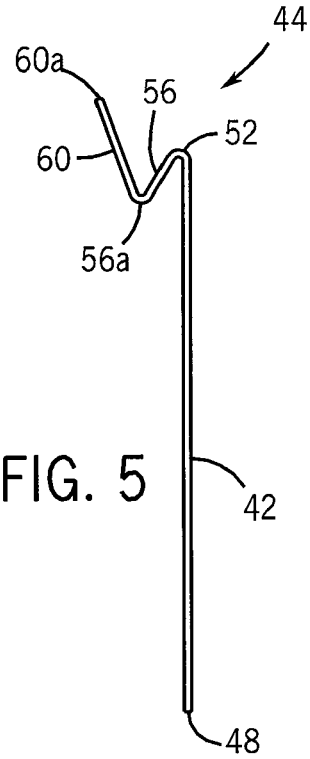
FIG. 5 is a side elevational view of a hook for securing the article holder of the present invention on a vertical surface.
Figure 6:
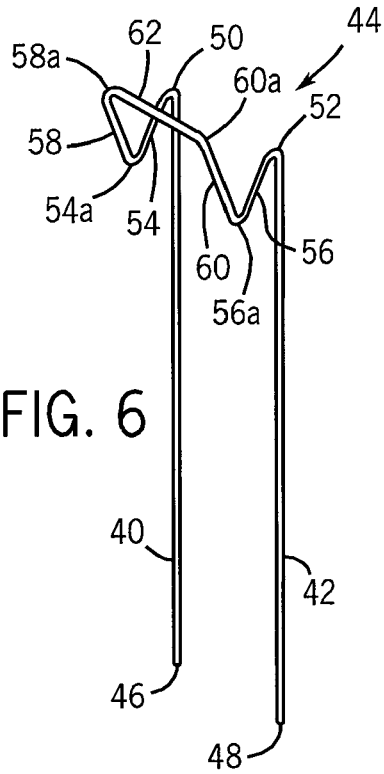
FIG. 6 is an isometric view of the hook of FIG. 5.
Figure 7:
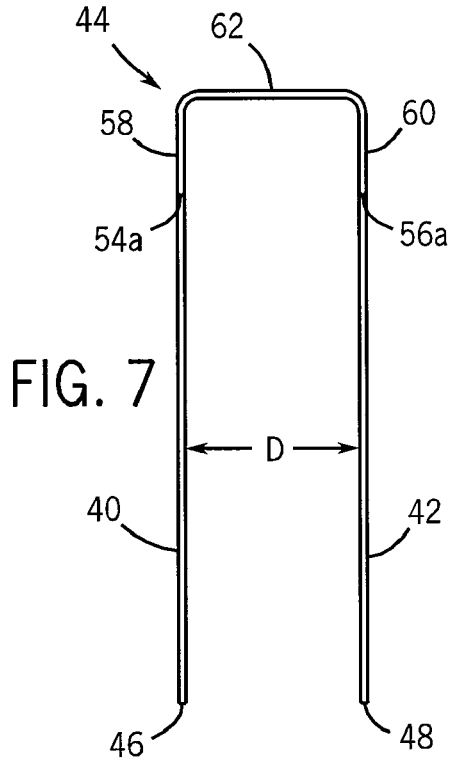
FIG. 7 is a front elevational view of the hook of FIG. 5.

Referring to FIGS. 5-7, hook 44 includes first and second legs 40 and 42, respectively, spaced by predetermined distance D. First and second legs 40 and 42, respectively, of hook 44 include corresponding lower ends 46 and 48, respectively, and corresponding upper ends 50 and 52, respectively. Hook 44 further includes first and second parallel hook elements 54 and 56, respectively, extending from corresponding upper ends 50 and 52, respectively, of first and second legs 40 and 42, respectively, at acute angles thereto. Upper legs 58 and 60 extend from corresponding terminal ends 54*a* and 56*a* of hook elements 54 and 56 at predetermined angles thereto. Terminal ends 58*a* and 60*a* of corresponding upper legs 58*a* and 60*a* are interconnected by cross leg 62.

In operation, first and second legs 40 and 42 of each hook 44 are inserted through corresponding pin holes 36 and 38 in backing plate 16 of article holder 12. Thereafter, lower ends 46 and 48 of corresponding first and second legs 40 and 42, respectively, of hook 44 are inserted into and penetrate a fabric wall covering positioned on vertical surface 14. First and second legs 40 and 42 of hook 44 are inserted between fabric wall covering and vertical surface 14 until such point as a corresponding end 18 or 20 of backing plate 16 becomes seated within the hooked portion of hook 44 between hook elements 54 and 56 and corresponding legs 40 and 42 thereof. As described, hooks 44 retain article holder 12 on vertical surface 12 having a fabric wall covering thereon.

Article holder 12 further includes a clip element generally designated by the reference numeral 70. Clip element 70 includes a generally flat wall 72 defined by first and second ends 74 and 76, respectively, and upper and lower edges 78 and 80, respectively. Wall 72 is further defined by an outer surface 82 and an inner surface 84 directed towards forward surface 28 of backing plate 16 so as to define cavity 86 therebetween. Upper edge 78 of wall 72 is interconnected to upper edge 22 of backing plate 16 by a generally rectangular upper wall 88. Upper wall 88 is generally perpendicular to wall 72 and backing plate 16, and is defined by first and second ends 90 and 92, respectively, and upper and lower surfaces 94 and 96, respectively. End 18 of backing plate 16, end 74 of wall 72 and end 90 of upper wall 98 lie in a common plane. Similarly, end 20 of backing plate 16, end 76 of wall 72 and end 92 of upper wall 88 lie in a common plane. It is noted that inner surface 96 of upper wall 88 also partially defines cavity 86 within article holder 12.

Article holder 12 further includes a retaining leg 98 extending upwardly from lower end 80 of wall 72 at an acute angle to wall 72 and terminating at terminal end 104. Retaining leg 98 has an inner surface 100 directed towards cavity 86 within article holder 12 and an outer surface 102. In its closed position, terminal end 104 of retaining leg 98 abuts forward surface 28 of backing plate 16. It is contemplated for retaining leg 98, as well as, wall 72 and backing plate 16 to be transparent, for reasons hereinafter described.

In operation, clip element 70 is provided in a closed position wherein terminal end 104 of retaining leg 98 engages backing plate 16, as heretofore described. In order to mount a sheet 10 within article holder 12, retaining leg 98 of article holder 12 is pivoted clockwise with respect to backing plate 16 to an open position so as to space terminal end 104 of retaining leg 98 from forward surface 28 of backing plate 16. More specifically, in order pivot retaining leg 98 of article holder 12 to the open position, a user pulls second end 76 of wall 72 such that wall 72 flexes and has a generally arcuate cross-section. In addition, upper wall 88 flexes such that upper wall 88 has a generally arcuate cross-section. This, in turn, draws terminal end 104 of retaining leg 98 away from backing plate 16. Thereafter, sheet 10 of material may be inserted into cavity 86 between backing plate 16 and terminal end 104 of retaining leg 98. It can be appreciated that by fabricating retaining leg 98 from a transparent material, a user may be able to view the portions of sheet 10 captured within cavity 86.

On sheet 10 is inserted into cavity 86 between backing plate 16 and terminal end 104 of retaining leg 98, second end 76 of wall 72 of clip element 70 of article holder 12 is released such that a terminal end 104 of retaining leg 98 returns to its closed position thereby engaging sheet 10 and capturing a portion of sheet 10 within cavity 86 of article holder 12. As a result, sheet is retained on vertical surface 14. In order to remove sheet 10 from cavity 86, clip element 70 may be once again pivoted clockwise with respect to backing plate 16, as heretofore described, thereby releasing sheet 10. Alternatively, the user may pull sheet 10 downwardly from cavity 86 in article holder 12

Various alternatives are contemplated as being within the following claims particularly pointing out and distinctly claiming the subject matter regarded as the invention.

We claim:

1. An article holder for supporting a sheet of material on a vertical surface, comprising:

a backing plate connectable to the vertical surface, the backing plate having an inner surface and upper edge;

a clip operatively connected to the backing plate, the clip including:

a face plate having an inner surface, an upper edge and a lower edge;

an upper wall interconnecting the upper edge of the face plate and the upper edge of the backing plate, the upper wall having an inner surface; and a retaining leg extending from the lower edge of the face plate and having a terminal end, the retaining leg moveable between a closed position wherein the terminal end of the retaining leg engages the inner surface of the backing plate and an open position wherein the retaining leg is spaced from the inner surface of the backing plate; and a hook extendable through the backing plate and into the vertical surface for retaining the backing plate on the vertical surface, the hook including first and second legs interconnected by a crossbar, the legs including first and second opposite ends and being generally parallel;

wherein the inner surface of the backing plate, the inner surface of the face plate and the inner surface of the upper wall define a cavity for receiving a portion of the sheet.

2. The article holder of claim 1 wherein the upper wall of the clip is generally perpendicular to the backing plate.

3. The article holder of claim 1 wherein the face plate of the clip is movable between a first, generally flat configuration with the retaining leg in the closed position and a second, generally arcuate configuration with the retaining leg in the open position.

4. The article holder of claim 1 wherein the upper wall of the clip is movable between a first, generally flat configuration with the retaining leg in the closed position and a second, generally arcuate configuration with the retaining leg in the open position.

5. The article holder of claim 1 wherein the backing plate has a width and the face plate of the clip has a width, the width of the backing plate being greater than the width of the face plate of the clip.

6. The article holder of claim 1 wherein the first ends of the first and second legs include hooked elements formed therein.

7. An article holder for supporting a sheet of material on a vertical surface, comprising:

a backing plate connectable to the vertical surface, the backing plate having inner and outer surfaces and an upper edge;

a flexible face plate having an inner surface, an upper edge and a lower edge;

a flexible upper wall interconnecting the upper edge of the face plate and the upper edge of the backing plate, the upper wall having an inner surface;

a hook extendable through the backing plate and into the vertical surface for retaining the backing plate on the vertical surface; the hook including first and second legs interconnected by a crossbar, the legs including first and second opposite ends and being generally parallel; and a retaining leg extending from the lower edge of the face plate and having a terminal end, the retaining leg moveable between a closed position wherein:

the terminal end of the retaining leg engages the inner surface of the backing plate;

the face plate is generally parallel to the backing plate; and the upper wall is generally perpendicular to the face plate and the backing plate;

and an open position wherein:

the retaining leg is spaced from the inner surface of the backing plate;

the face plate has a generally arcuate cross-section; and the upper wall has a generally arcuate cross-section.

8. The article holder of claim 7 wherein the inner surface of the backing plate, the inner surface of the face plate and the inner surface of the upper wall define a cavity for receiving a portion of the sheet.

9. The article holder of claim 7 wherein the backing plate has a width and the face plate has a width, the width of the backing plate being greater than the width of the face plate of the clip.

10. The article holder of claim 7 wherein the first ends of the first and second legs include hooked elements formed therein.

11. An article holder for supporting a sheet of material on a vertical surface, comprising:

a backing plate connectable to the vertical surface, the backing plate having inner and outer surfaces, upper edge and a width;

a clip operatively connected to the backing plate, the clip including:

a face plate having an inner surface, an upper edge, a lower edge and a width;

an upper wall interconnecting the upper edge of the face plate and the upper edge of the backing plate, the upper wall having an inner surface; and a retaining leg extending from the lower edge of the face plate and having a terminal end, the retaining leg moveable between a closed position wherein the terminal end of the retaining leg engages the inner surface of the backing plate and the face plate is generally parallel to the backing plate, and an open position wherein the retaining leg is spaced from the inner surface of the backing plate and the face plate has a generally arcuate cross-section;

wherein:

the upper wall is generally perpendicular to the face plate and the backing plate with the retaining leg in the closed position and the upper wall has a generally arcuate cross-section with the retaining leg in the open position.

12. The article holder of claim 11 wherein the inner surface of the backing plate, the inner surface of the face plate and the inner surface of the upper wall define a cavity for receiving a portion of the sheet.

13. The article holder of claim 11 wherein the width of the backing plate being greater than the width of the face plate of the clip.

14. The article holder of claim 11 wherein the article holder further comprises an adhesive provided on the outer surface of the backing plate for affixing the backing plate to the vertical surface.

15. An article holder for supporting a sheet of material on a vertical surface, comprising:

a backing plate connectable to the vertical surface, the backing plate having inner and outer surfaces, upper edge and a width;

a clip operatively connected to the backing plate, the clip including:

a face plate having an inner surface, an upper edge, a lower edge and a width;

an upper wall interconnecting the upper edge of the face plate and the upper edge of the backing plate, the upper wall having an inner surface; and a retaining leg extending from the lower edge of the face plate and having a terminal end, the retaining leg moveable between a closed position wherein the terminal end of the retaining leg engages the inner surface of the backing plate and the face plate is generally parallel to the backing plate, and an open position wherein the retaining leg is spaced from the inner surface of the backing plate and the face plate has a generally arcuate cross-section;

a hook extendable through the backing plate and into the vertical surface for retaining the backing plate on the vertical surface, the hook includes first and second legs interconnected by a crossbar, the legs including first and second opposite ends and being generally parallel.

16. The article holder of claim 15 wherein the retaining leg is transparent.

* * * * *